US010760373B2

(12) United States Patent
Phan et al.

(10) Patent No.: US 10,760,373 B2
(45) Date of Patent: Sep. 1, 2020

(54) SYSTEM TO CONTROL EXTRUSION GAPS IN AN ANTI-EXTRUSION DEVICE

(71) Applicant: Halliburton Energy Services, Inc., Houston, TX (US)

(72) Inventors: Anthony Phan, Lewisville, TX (US); Jack Gammill Clemens, Fairview, TX (US); Mark Holly, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 252 days.

(21) Appl. No.: 15/757,300

(22) PCT Filed: Apr. 6, 2017

(86) PCT No.: PCT/US2017/026410
§ 371 (c)(1),
(2) Date: Mar. 2, 2018

(87) PCT Pub. No.: WO2018/186869
PCT Pub. Date: Oct. 11, 2018

(65) Prior Publication Data

US 2019/0071948 A1 Mar. 7, 2019

(51) Int. Cl.
*E21B 33/12* (2006.01)
*E21B 33/127* (2006.01)
(Continued)

(52) U.S. Cl.
CPC ..... *E21B 33/1216* (2013.01); *E21B 33/12* (2013.01); *E21B 33/127* (2013.01);
(Continued)

(58) Field of Classification Search
CPC ... E21B 33/10; E21B 33/1216; E21B 33/1208
See application file for complete search history.

(56) References Cited

U.S. PATENT DOCUMENTS 4,491,178 A 1/1985 Terrell et al.
4,611,658 A 9/1986 Salemi et al.
(Continued)

OTHER PUBLICATIONS

International Search Report and Written Opinion dated Jan. 5, 2018, International PCT Application No. PCT/US2017/026410.

*Primary Examiner* — Tara E Schimpf
(74) *Attorney, Agent, or Firm* — McGuire Woods LLP

(57) ABSTRACT

Disclosed embodiments include a retrievable bridge plug assembly. The retrievable bridge plug assembly includes a sealing element that is elastically deformable to expand radially outward when the sealing element experiences axial compression and at least one anti-extrusion device positioned downhole from the sealing element. The at least one anti-extrusion device includes a shoulder that in operation maintains contact with the sealing element. Also included in the at least one anti-extrusion device is a plurality of anti-extrusion petals positioned downhole from the shoulder that expand radially outward from the anti-extrusion device. Additionally, the at least one anti-extrusion device includes an expandable sleeve surrounding the plurality of anti-extrusion petals that covers extrusion gaps of the plurality of anti-extrusion petals when the plurality of anti-extrusion petals expand radially outward from the anti-extrusion device.

18 Claims, 6 Drawing Sheets

(51) Int. Cl.

| | |
|---|---|
| ***E21B 33/128*** | (2006.01) |
| ***E21B 33/134*** | (2006.01) |
| ***E21B 43/10*** | (2006.01) |
| ***E21B 43/26*** | (2006.01) |
| *E21B 33/00* | (2006.01) |

(52) U.S. Cl.

CPC ..... *E21B 33/128* (2013.01); *E21B 33/1208* (2013.01); *E21B 33/1277* (2013.01); *E21B 33/134* (2013.01); *E21B 43/105* (2013.01); *E21B 43/26* (2013.01); *E21B 2033/005* (2013.01)

(56) References Cited

U.S. PATENT DOCUMENTS

| | | | | |
|---|---|---|---|---|
| 5,165,703 | A | 11/1992 | Morvant | |
| 2011/0073329 | A1 | 3/2011 | Clemens et al. | |
| 2012/0133098 | A1 | 5/2012 | Farquhar | |
| 2013/0153219 | A1* | 6/2013 | Abrahamsen ..... | E21B 33/1208 166/285 |
| 2014/0262351 | A1 | 9/2014 | Derby | |
| 2015/0204159 | A1 | 7/2015 | Morehead | |
| 2019/0301263 | A1* | 10/2019 | Atkins ..... | E21B 33/1216 |

* cited by examiner

SYSTEM TO CONTROL EXTRUSION GAPS IN AN ANTI-EXTRUSION DEVICE

BACKGROUND

The present disclosure relates generally to retrievable bridge plugs used within a well, and more specifically to improvement of anti-extrusion functionalities of the retrievable bridge plugs when positioned in the well.

While completing a well, it may be beneficial at certain times to seal portions of the well from production or to generate temporary zonal isolation of portions of the well from a treatment procedure. For example, when performing a hydraulic fracturing operation in one zone within the well, it may be desirable to provide a retrievable bridge plug downhole from the treatment location to isolate portions of the well that have already been fractured from a subsequent hydraulic fracturing operation.

A high expansion retrievable bridge plug is particularly suited as a zonal isolation barrier for a workover process within the well. However, due to a high expansion nature of the high expansion retrievable bridge plug, clearance gaps between the plug and the well and between individual petals of an anti-extrusion device may be large. Due to the large clearance gaps, the high expansion retrievable bridge plug may not provide sufficient control over a sealing element of the high expansion retrievable bridge plug when exposed to high differential pressure. Additionally, debris located in wells with debris restrictions that limit an internal diameter of the well may impact operation of external mechanisms of the high expansion retrievable bridge plug.

BRIEF DESCRIPTION OF THE DRAWINGS

Illustrative embodiments of the present disclosure are described in detail below with reference to the attached drawing figures, which are incorporated by reference herein, and wherein.

Figure 1:
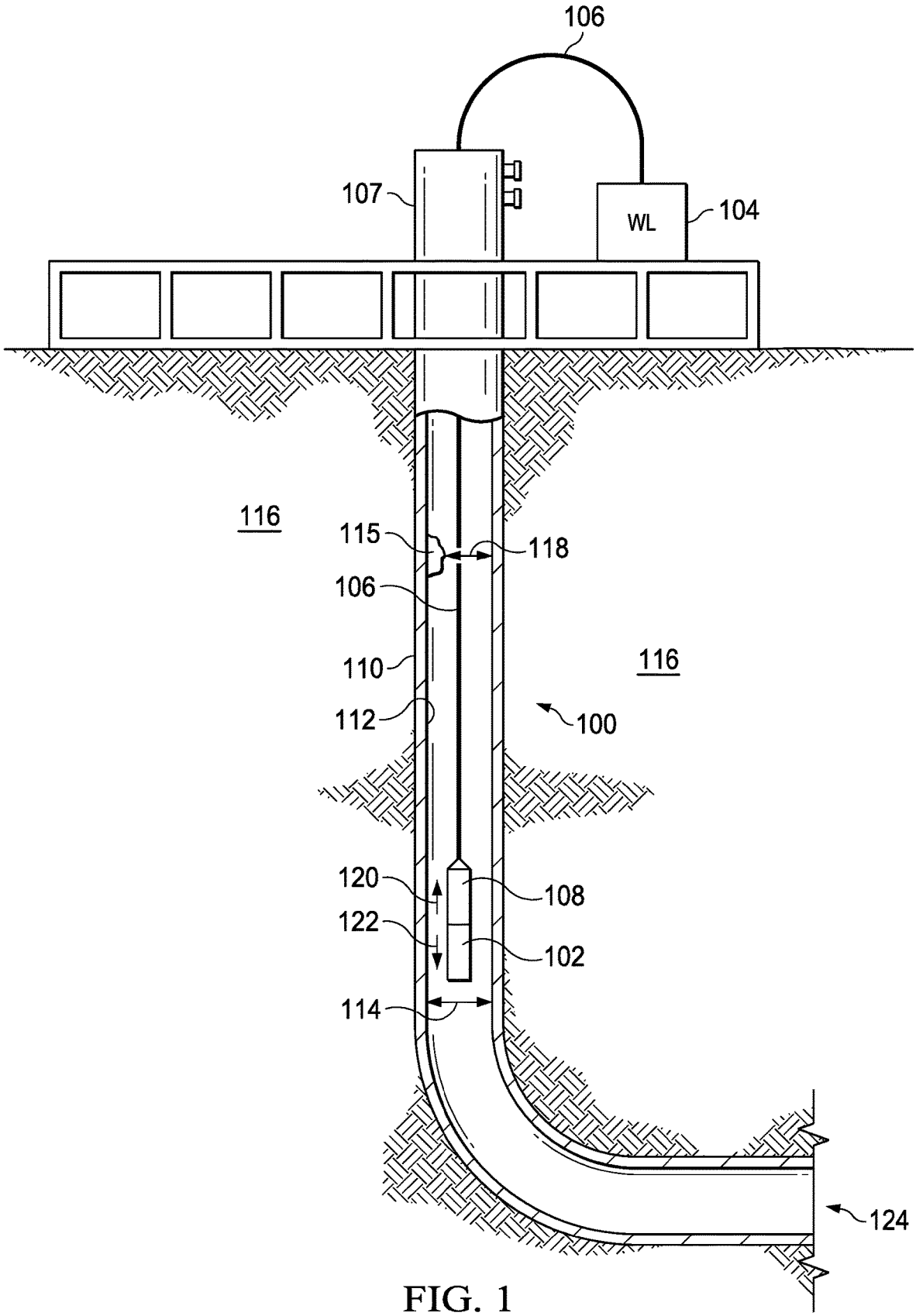
FIG. 1 is a schematic illustration of a well during installation of a high expansion retrievable bridge plug.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the disclosed subject matter, and it is understood that other embodiments may be utilized and that logical structural, mechanical, electrical, and chemical changes may be made without departing from the spirit or scope of the disclosure. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As used herein, the singular forms "a", "an," and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the embodiments and figures provided below are merely illustrative and do not imply that any particular step or component is a requirement of a claimed embodiment.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

The present disclosure relates to a high expansion retrievable bridge plug that provides the ability to seal portions of a well from production or to temporarily seal zones of a well from treatment. More particularly, the present disclosure relates to a high expansion retrievable bridge plug with one or more supportive sleeves on an anti-extrusion device of the plug and/or on a sealing element of the plug. The presently disclosed embodiments may be used in horizontal, vertical, deviated, or otherwise nonlinear wellbores in any type of subterranean formation. Further, the presently disclosed embodiments may be used in either onshore or offshore drilling operations. Embodiments may be implemented to anchor the retrievable bridge plug within the wellbore, or to provide a platform to hold other downhole tools such as a cement plug or a whipstock.

Referring to FIG. 1, a schematic illustration of a well 100 during installation of a high expansion retrievable bridge plug 102 is provided. Installation of the high expansion retrievable bridge plug 102, as illustrated, is provided by a wireline system 104 that runs a wireline 106 through a wellhead 107 and downhole into the well 100 to position the high expansion retrievable bridge plug 102 and a downhole power unit 108 at a desired downhole location. While FIG. 1 shows the high expansion retrievable bridge plug 102 and the downhole power unit 108 being deployed using the wireline system 104, the high expansion retrievable bridge plug 102 and the downhole power unit 108 may also be deployed using coiled tubing systems, slickline systems, wireline tractor systems, or any other system suitable for placement of the high expansion retrievable bridge plug 102 within the well 100.

A wellbore 110 of the well 100 includes a casing 112. An internal diameter 114 of the casing 112 is larger than a diameter of the high expansion retrievable bridge plug 102 and the downhole power unit 108. In an embodiment where the wellbore 110 undergoes a workover operation, debris 115 from the casing 112 or a formation 116 may cause portions of the wellbore 110 to include a reduced internal diameter 118. Because of the potential for the presence of the reduced internal diameter 118, the diameter of the high expansion retrievable bridge plug 102 and the downhole power unit 108 may be two or more inches smaller than the internal diameter 114 of the casing 112. With a smaller diameter, the high expansion retrievable bridge plug 102 and the downhole power unit 108 are able to travel downhole within the wellbore 110 to a desired location to deploy the high expansion retrievable bridge plug 102.

When the high expansion retrievable bridge plug 102 reaches a desired location within the wellbore 110, the high expansion retrievable bridge plug 102 is deployed to provide a plug between a zone uphole from the high expansion retrievable bridge plug 102 and a zone downhole from the high expansion retrievable bridge plug 102. The high expansion retrievable bridge plug 102 transitions from a running state, as illustrated in FIG. 1, to a gripping state using the downhole power unit 108. The downhole power unit 108 transmits an axial force with respect to a vertical axis running through a center of the high expansion retrievable bridge plug 102 in an uphole direction to an actuation rod that runs through the high expansion retrievable bridge plug 102. The axial force on the actuation rod results in compression of a sealing element of the high expansion retrievable bridge plug 102 that provides sealing contact between the sealing element and the casing 112. By way of example, the high expansion retrievable bridge plug 102 may expand from the running configuration with a two and one eighth inch outer diameter to the gripping state having a diameter of approximately seven inches to provide a seal across the internal diameter 114 of the casing 112. Other expansions larger and smaller than the expansion described above are also contemplated for the high expansion retrievable bridge plug 102. For example, while an expansion ratio of 3.3 is described above (e.g., 7 inches divided by 2.125 inches), expansion ratios of approximately 2.0, 2.5, 3.0, 3.5, and 4.0 are also contemplated. As used herein, approximately refers to a value within 10 percent of an indicated value. For example, the expansion ratio of approximately 2.0 covers a range of expansion ratios from 1.8 to 2.2.

The downhole power unit 108 may include an elongated housing, a motor disposed in the housing, and a sleeve connected to a rotor of the motor. The sleeve is a rotation member that rotates with the motor. A moveable member, such as the actuation rod described above, is received within a threaded interior of the sleeve. Operation of the motor rotates the sleeve, which causes the actuation rod to move in a longitudinal direction 120 or 122. When the downhole power unit 108 causes the actuation rod to move in the longitudinal direction 120, the high expansion retrievable bridge plug 102 is actuated to the gripping state. Alternatively, when the downhole power unit 108 causes the actuation rod to move in the longitudinal direction 122, the high expansion retrievable bridge plug 102 is returned to the running state.

While FIG. 1 provides a specific depiction of operations within a vertical portion of the well 100, it is understood by those skilled in the art that the high expansion retrievable bridge plug 102 is equally well-suited for use in deviated wells, inclined wells, horizontal wells, multi-lateral wells, and the like. The use of directional term uphole refers to a direction within the well 100 toward the wellhead 107, and the use of the directional term downhole refers to a direction within the well 100 toward a bottom 124 of the well 100. Further, even though FIG. 1 illustrates an onshore operation, it is understood by those skilled in the art that the high expansion retrievable bridge plug 102 is equally well-suited for use in offshore operations. Additionally, even though FIG. 1 depicts the casing 112 within the wellbore 110, the high expansion retrievable bridge plug 102 is equally well-suited for use in open hole operations.

Figure 2:
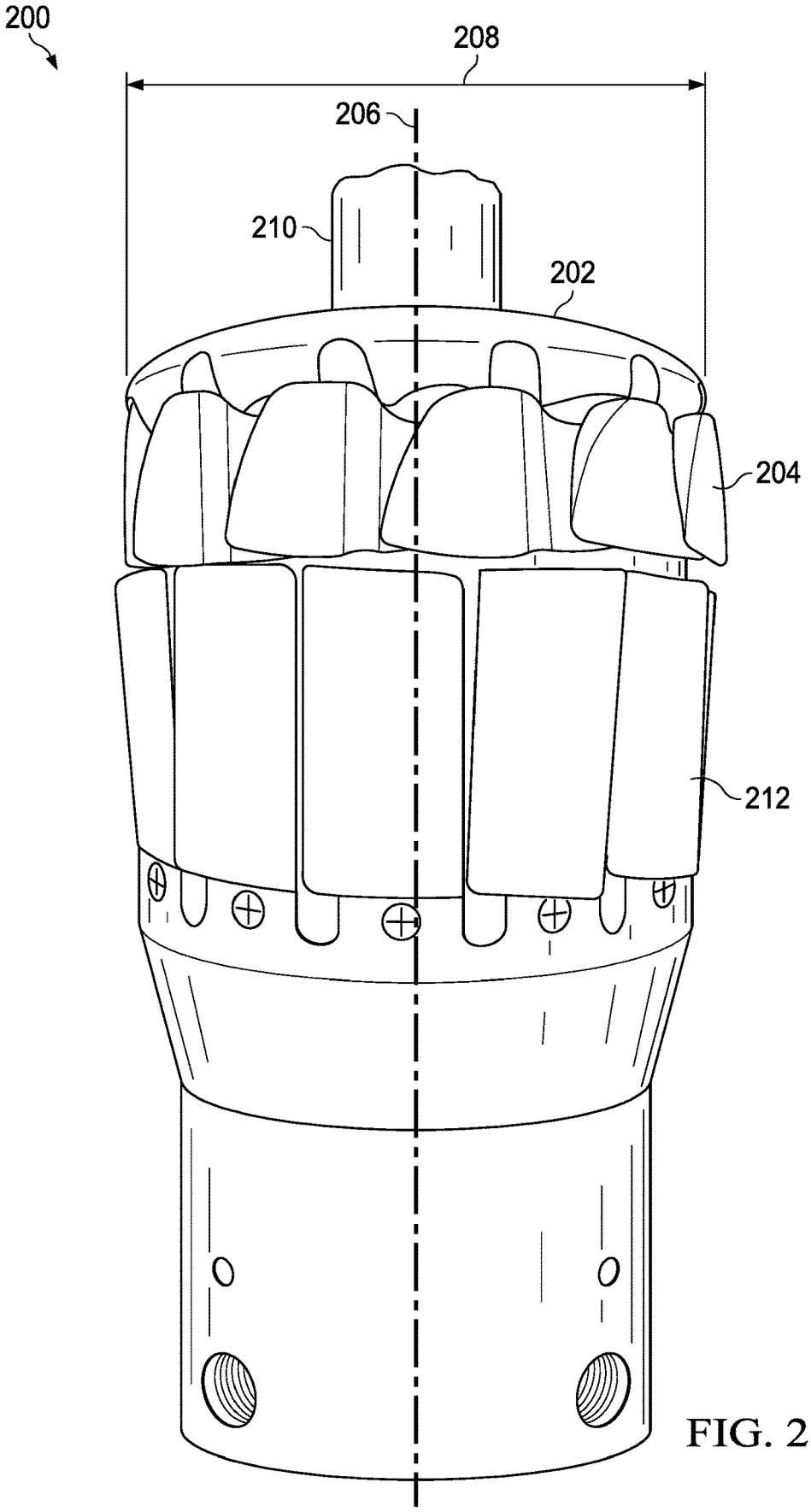
FIG. 2 is a side view of an anti-extrusion device of the high expansion retrievable bridge plug of FIG. 1.

FIG. 2 is a side view of an anti-extrusion device 200 of the high expansion retrievable bridge plug 102 while the anti-extrusion device 200 is in the running state. The anti-extrusion device 200 includes a shoulder 202 that to maintains contact with a downhole tool positioned uphole from the anti-extrusion device 200. For example, with reference to FIG. 1, the shoulder 202 maintains contact with the sealing element of the high expansion retrievable bridge plug 102 when the high expansion retrievable bridge plug 102 is in both the running state and the gripping state.

The anti-extrusion device 200 also includes a plurality of anti-extrusion petals 204 positioned downhole from the shoulder 202. The anti-extrusion petals 204 expand radially outward from a longitudinal axis 206 of the anti-extrusion device 200 to a diameter greater than a diameter 208 of the shoulder to engage walls of the casing 112 within the wellbore 110. The anti-extrusion petals 204 expand radially outward when the anti-extrusion device 200 is actuated to the gripping state by uphole movement of an actuation rod 210, which is positioned along the longitudinal axis 206 of the anti-extrusion device 200. As the anti-extrusion device 200 is actuated into the gripping state, the anti-extrusion petals 204 expand radially outward from the anti-extrusion device 200, and support arms 212 also expand radially outward to provide support to the anti-extrusion petals 204.

In an embodiment, the anti-extrusion petals 204 may not extend radially outward an entire distance to engage the walls of the casing 112 or the wellbore 110, and may instead extend radially outward to a position that is proximate to the walls of the casing 112 or the wellbore 110. In such an embodiment, the anti-extrusion petals 204 provide a supporting platform for the sealing element to provide sufficient anti-extrusion support. As used herein, the term "proximate to" is used to indicate that the anti-extrusion petals 204 extend radially outward to a position that is within an inch of the casing 112 or the wellbore 110 on either side of the anti-extrusion petals 204. It is also anticipated that, in other embodiments, the anti-extrusion petals 204 extend radially outward to a position that is within one-half inch, two inches, three inches, or more from the casing 112 or the wellbore 110 depending on the size of the casing 112, the wellbore 110, and/or the anti-extrusion petals 204.

Figure 3:
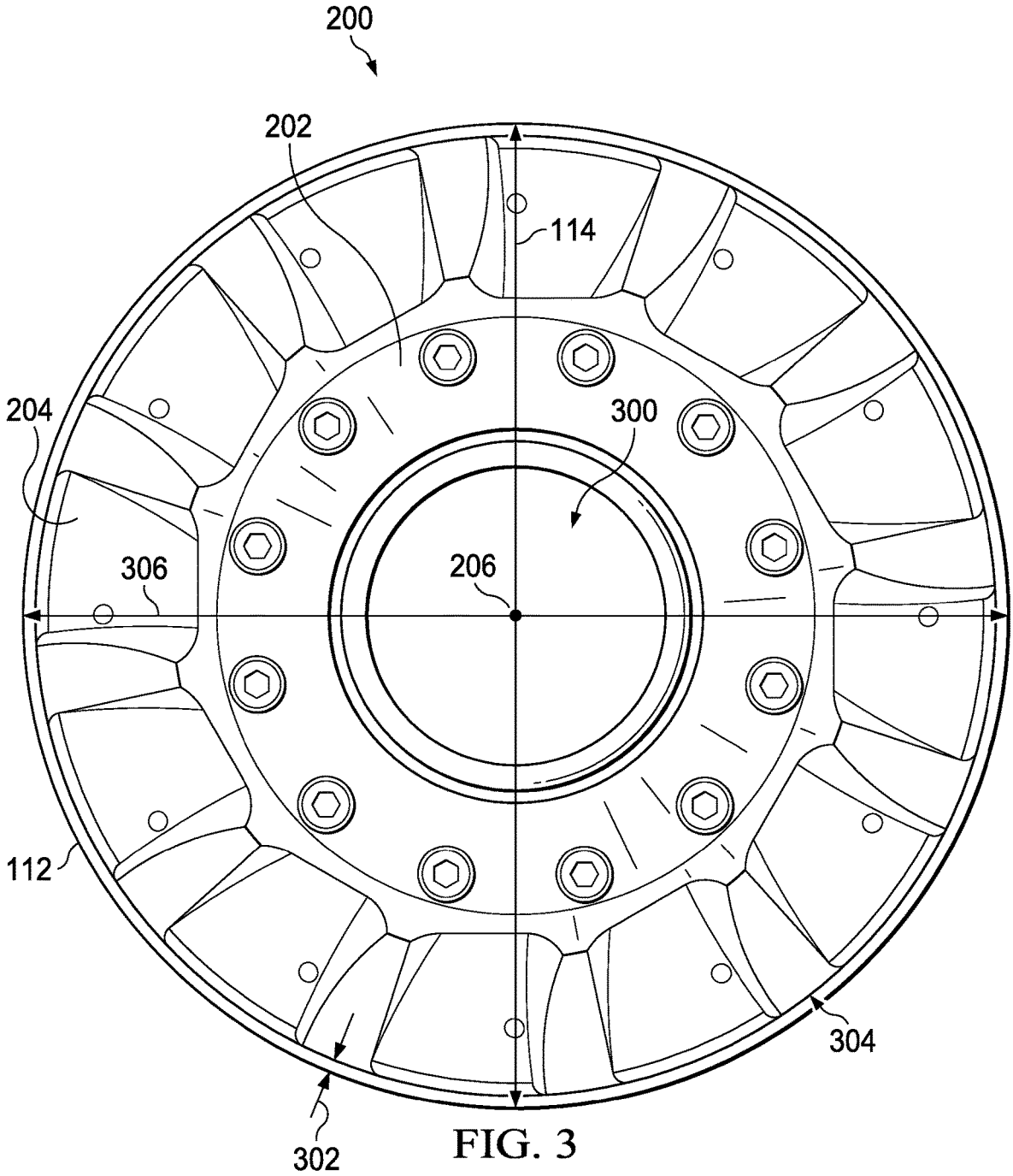
FIG. 3 is an overhead view of the anti-extrusion device of FIG. 2.

Turning to FIG. 3, an overhead view of the anti-extrusion device 200, which is actuated to the gripping state, within the casing 112 of the well 100 is illustrated. The anti-extrusion device 200 includes an orifice 300 centered on the longitudinal axis 206. The orifice 300 receives the actuation rod 206, as discussed with reference to FIG. 1, which provides a force on the anti-extrusion device 200 to actuate the anti-extrusion petals 204 of the anti-extrusion device 200. Upon actuation, the anti-extrusion petals 204 extend radially outward from the longitudinal axis 206 of the anti-extrusion device 200. While in the gripping state, a wall gap 302 and a petal gap 304 may be present. The wall gap 302 may be created when the anti-extrusion petals 204 extend to an anti-extrusion diameter 306 that is slightly smaller than the internal diameter 114 of the casing 112. The petal gap 304 is a gap between the anti-extrusion petals 204 when the anti-extrusion petals 204 are expanded. The wall gap 302 and the petal gaps 304 may provide paths for well fluids within the well 100 to pass through the anti-extrusion device 200 to the sealing element. As used herein, the term "well fluids" is used to describe both liquids and gases found within the well 100.

Figure 4:
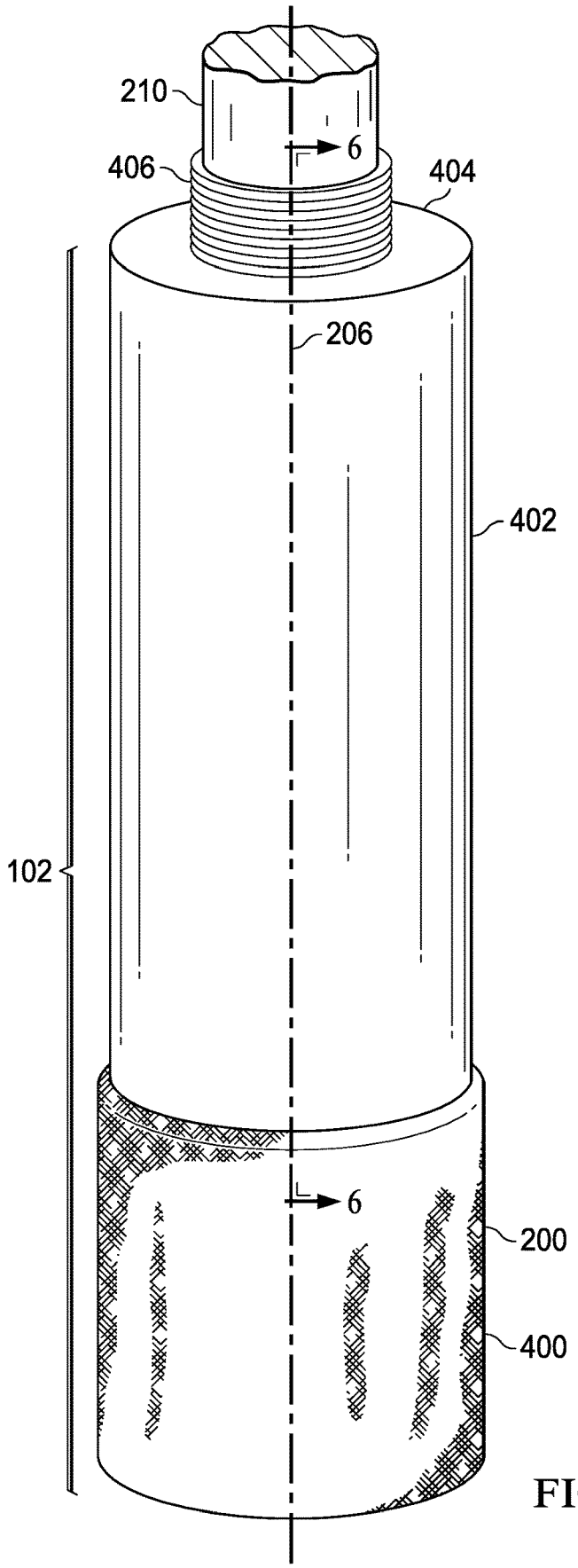
FIG. 4 is a side view of the high expansion retrievable bridge plug including the anti-extrusion device of FIG. 2 within an expandable sleeve and a sealing element.

FIG. 4 is a side view of the high expansion retrievable bridge plug 102 including the anti-extrusion device 200 within an expandable sleeve 400 and a sealing element 402. The sealing element 402 is positioned between an uphole shoulder 404 of the high expansion retrievable bridge plug 102 and the anti-extrusion device 200. The downhole motor 108, as described with respect to FIG. 1, couples to a coupling point 406, and provides actuating force on the actuation rod 206 to actuate the high expansion retrievable bridge plug 102 to the gripping state. The sealing element 402 is longitudinally compressed between the uphole shoulder 404 and the anti-extrusion petals 204 and the shoulder 202 of the anti-extrusion device 200. In this manner, the sealing element 402 expands radially outward from the longitudinal axis 206 until the sealing element 402 reaches the casing 112 or a wall of the wellbore 110 to generate a sealing engagement between the high expansion retrievable bridge plug 102 and the casing 112 or a wall of the wellbore 110. In an embodiment, an additional anti-extrusion device 200 with or without the expandable sleeve 400 is positioned uphole from the sealing element 402 such that the sealing element 402 is supported at both an uphole position and a downhole position by the anti-extrusion petals 204 and the shoulders 202 of the two anti-extrusion devices 200. To achieve a desired longitudinal compression of the sealing element 402, the sealing element 402 is formed from a polymer material such as an elastomer, a thermoset, a thermoplastic, or the like. As an example, the sealing element 402 may be polychloroprene rubber (CR), natural rubber (NR), polyether eurethane (EU), styrene budadiene rubber (SBR), ethylene propylene (EPR), ethylene propylene diene (EPDM), a nitrile rubber, a copolymer of acrylonitrile and butadiene (NBR), carboxylated acrylonitrile butadiene (XNBR), or any other polymer materials suitable to achieve the desired longitudinal compression.

The expandable sleeve 400 surrounding the anti-extrusion device 200 provides support for the anti-extrusion device 200 when the anti-extrusion device 200 is deployed to the gripping state. The expandable sleeve 400 is a nylon and rubber composite made by liquid injection molding, injection molding, compression molding, transfer molding, hand layup molding, or any combination thereof. Both the nylon and the rubber of the expandable sleeve 400 are compatible with wellbore fluid such that the nylon and the rubber does not degrade while in contact with wellbore fluid. By way of example, the nylon may be a synthetic polymer that is compatible with oil and gas within the well 100. Additionally, the rubber may be hydrogenated nitrile butadiene rubber (HNBR) or any other rubber material that is compatible with the oil and gas within the well 100. In an embodiment, the expandable sleeve 400 may be made from at least 20% rubber. In another embodiment, the expandable sleeve 400 may be include between 25% and 95% nylon or carbon fiber. Further, in an embodiment, the expandable sleeve 400 may also comprise carbon fiber, composite cords, other materials, or a combination thereof, in addition to or in place of the nylon and rubber composite. Similar to the nylon and rubber composite material, the carbon fiber, composite cords, and any additional materials used in the expandable sleeve 400 are compatible with the oil and gas within the well 100.

The expandable sleeve 400 is expandable such that the anti-extrusion device 200 is capable of extending to the gripping state while maintaining the presence of the expandable sleeve 400 around the anti-extrusion device 200. During operation, the expandable sleeve 400 covers the petal gaps 304 between the anti-extrusion petals 204. In an embodiment, the expandable sleeve 400 also limits the wall gap 302 between the anti-extrusion petals 204 and the casing 112 or the wall of the wellbore 110. For example, if the anti-extrusion diameter 306 is 6.5 inches, and the internal diameter of the casing 112 is 7 inches, a thickness of the expandable sleeve 400 may be selected to cover the additional 0.5 inch wall gap 302.

By reducing or eliminating the petal gaps 304 and the wall gap 302, the expandable sleeve 400 minimizes exposure of the sealing element 402 to wellbore fluid, which may cause nibbling and extrusion at the sealing element 402 under a high differential pressure (e.g., a differential pressure of greater than approximately 2500 psi). Friction between the anti-extrusion petals 204 and the sealing element 402 is also reduced as the expandable sleeve 400, in an embodiment, has a coefficient of friction that is less than a coefficient of friction of the anti-extrusion petals 204. Moreover, the expandable sleeve 400 provides a physical barrier between debris within the well 100 and mechanical mechanisms of the anti-extrusion device 200. Therefore, the expandable sleeve 400 prevents mechanical malfunctions resulting from debris in the well 100.

To provide additional support to the anti-extrusion device 200 in the gripping state, the expandable sleeve 400 may include an additional layer of steel mesh or an additional layer of expandable fiber (e.g., expandable woven carbon fibers, expandable para-aramid synthetic fibers, etc.) in addition to the nylon and rubber composite. The additional layer of steel mesh or expandable fiber provides increased robustness of the expandable sleeve 400 to prevent rips or tears in the nylon and rubber composite of the expandable sleeve 400 as the high expansion retrievable bridge plug 102 is run in and out of the well 100. Further, by increasing support provided to the anti-extrusion device 200 and reducing or eliminating the wall gap 302 and the petal gaps 304, an operation envelope of the high expansion retrievable bridge plug 102 is expanded. For example, the high expansion retrievable bridge plug 102 that includes the expandable sleeve 400 may be capable of holding approximately 4000 psi applied from an uphole direction or a downhole direction on the high expansion retrievable bridge plug 102.

Figure 5:
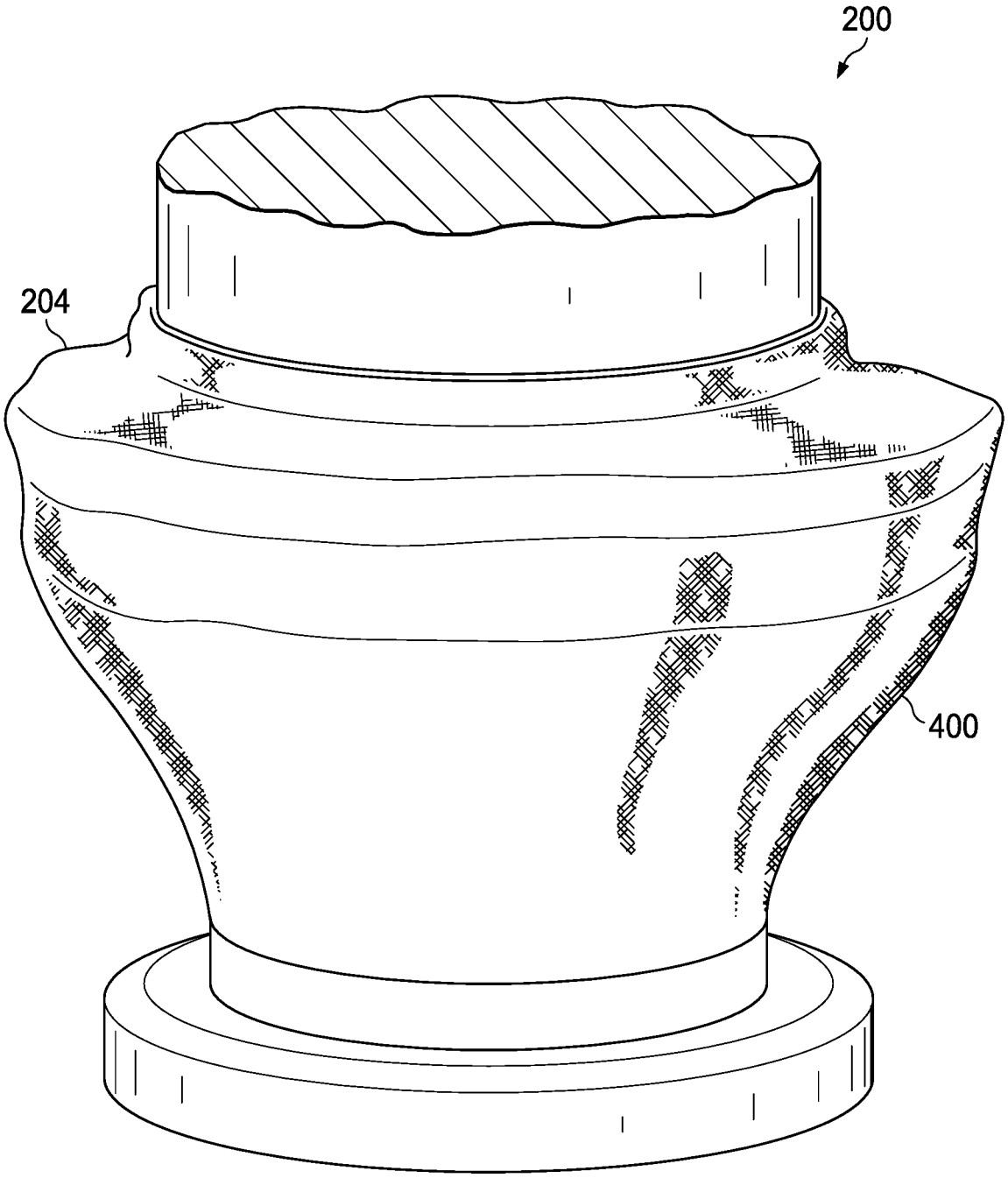
FIG. 5 is a side view of the anti-extrusion device within the expandable sleeve of FIG. 4.

FIG. 5 is a side view of the anti-extrusion device 200 within the expandable sleeve 400 in the gripping state. In the illustrated gripping state, the anti-extrusion petals 204 are extended beneath the expandable sleeve 400, and the expandable sleeve 400 expands with the anti-extrusion petals 204. While the anti-extrusion device 200 is described above as a portion of the high expansion retrievable bridge plug 102 to provide zonal isolation within the well 100, the anti-extrusion device 200 is also available for use in other embodiments without the sealing element 402. For example, the anti-extrusion device 200 is capable of providing an anchored platform within the wellbore 110 or the casing 112 to hold a cement plug (e.g., a through tubing bridge plug) and other wellbore barriers or downhole tools such as whipstocks or other isolation plugs. Additionally, the orifice 300 of the anti-extrusion device 200, as depicted in FIG. 3, may provide a mechanical choke for wellbore fluid within the well 100. As an example, when the expandable sleeve 400 is positioned around the anti-extrusion device 200, the wellbore fluid is forced to travel uphole through the flow restricting orifice 300.

Figure 6:
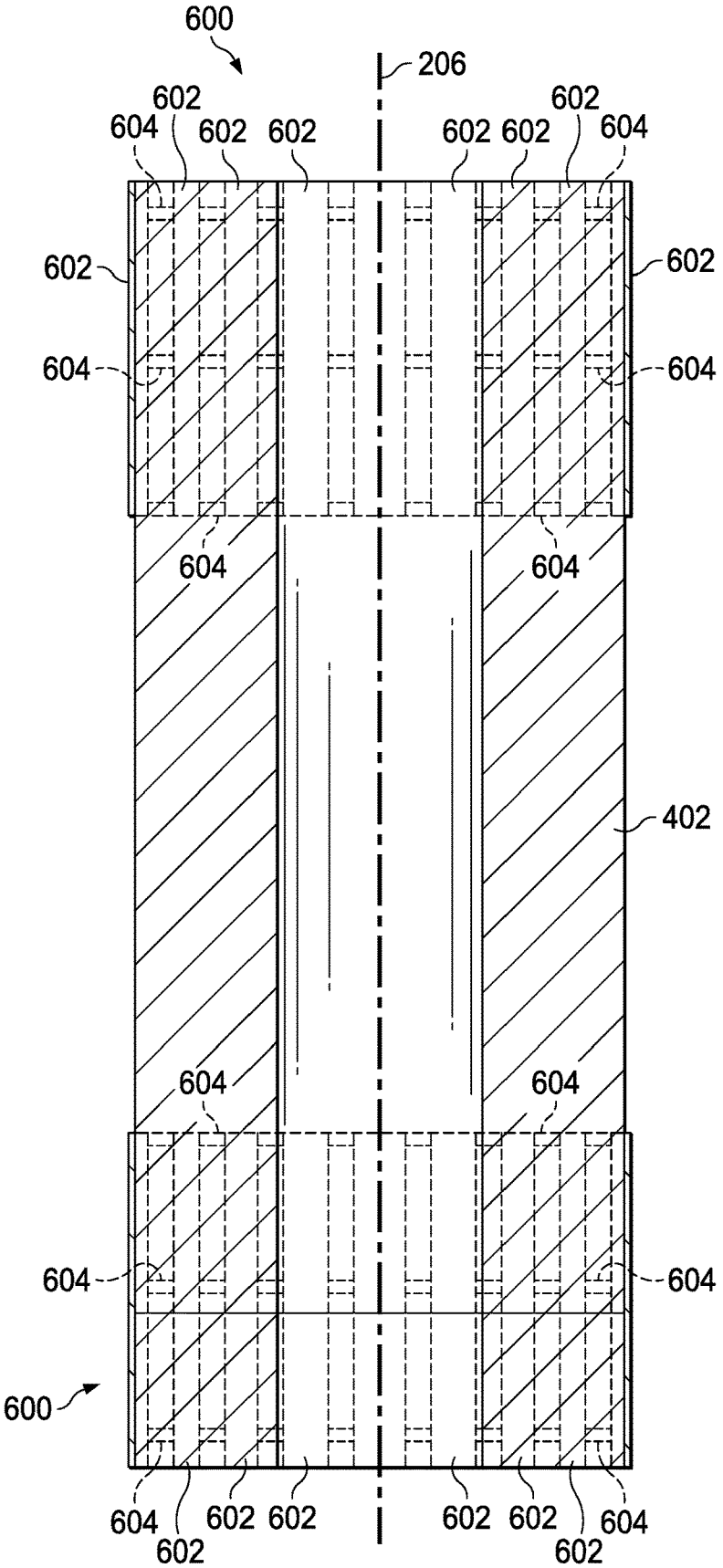
FIG. 6 is a sectional view of the sealing element of FIG. 4 with anti-extrusion reinforcement.

FIG. 6 is a sectional view of an embodiment of the sealing element 402 taken from lines 6-6 of FIG. 4. The illustrated embodiment includes a pair of composite sleeves 600 provided over either end of the sealing element 402. The composite sleeves 600 include reinforcement bands 602 with a parallel orientation to the longitudinal axis 206. Linking bands 604 are provided around the reinforcement bands 602 to link the reinforcement bands 602 together. The reinforcement bands 602 are made with metallic or non-metallic bands (e.g., carbon fibers, glass fibers, aramids, or any combination thereof). Additionally, the linking bands 604 are made with metallic or non-metallic bands (e.g., carbon fibers, glass fibers, aramids, or any combination thereof). The linking bands 604 may be designed and built have a lower tensile strength than the reinforcement bands 602. Accordingly, as the sealing element 402 is compressed, the linking bands 602 break to enable compression at the ends of the sealing element 402, and the reinforcement bands 602 provide the sealing element 402 with greater stability under compression. In this manner, the reinforcement bands 602 provide an anti-extrusion support for the sealing element 402, and the reinforcement bands 602 provide protection of the sealing element 402 from the anti-extrusion petals 204 of the anti-extrusion device 200. In an embodiment, the composite sleeves 600 may be replaced by a single composite sleeve 600 traversing an entire length of the sealing element 402.

The composite sleeves 600 may be included in embodiments when the anti-extrusion device 200 includes the expandable sleeve 400 or when the anti-extrusion device 200 does not include the expandable sleeve 400. When the expandable sleeve 400 is not included, the composite sleeves 600 provide anti-extrusion support for the sealing element 402 that is lacking from the anti-extrusion device 200. In such an embodiment, the sealing element 402 is able to maintain a seal with walls of the casing 112 or the wellbore 110 at a pressure of 4000 psi or more applied from an uphole direction or a downhole direction on the high expansion retrievable bridge plug 102. In an embodiment where the expandable sleeve 400 is included on the anti-extrusion device 200, use of the composite sleeves 600 provides additional support on the sealing element 402 and additional protection of the sealing element 402 when the sealing element 402 is under pressure. In such an embodiment, the high expansion retrievable bridge plug 200 may maintain a seal with walls of the casing 112 or the wellbore 110 under a high pressure applied from an uphole direction or a downhole direction on the high expansion retrievable bridge plug 200.

In an embodiment, the composite sleeves 600 may also be used on other downhole tools within the well 100. For example, the composite sleeves 600 may be included in packers, thru tubing bridge plugs, and any other wellbore sealing devices. These additional downhole tools may, for example, be tools with "swell" type elastomers. That is, elastomers that are longitudinally compressed to swell in a radially outward direction from the longitudinal axis 206.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a retrievable bridge plug assembly, comprising: a sealing element that is elastically deformable to expand radially outward when the sealing element experiences axial compression; and at least one anti-extrusion device positioned downhole from the sealing element, the at least one anti-extrusion device comprising: a shoulder configured to maintain contact with the sealing element; a plurality of anti-extrusion petals positioned downhole from the shoulder and configured to expand radially outward from the anti-extrusion device when the anti-extrusion device is in a gripping state; and an expandable sleeve surrounding the plurality of anti-extrusion petals that covers extrusion gaps of the plurality of anti-extrusion petals when the plurality of anti-extrusion petals expand radially outward from the anti-extrusion device.

Clause 2, the assembly of clause 1, wherein the expandable sleeve comprises a nylon and rubber composite fabric, wherein the nylon and rubber composite fabric is chemically compatible with fluids present within the wellbore.

Clause 3, the assembly of clause 2, wherein the nylon and rubber composite fabric is made using liquid injection molding, injection molding, compression molding, or a combination thereof.

Clause 4, the assembly of at least one of clauses 1-3, wherein the plurality of anti-extrusion petals expand radially outward when the anti-extrusion device experiences pressure originating uphole from the anti-extrusion device, pressure originating downhole from the anti-extrusion device, or both.

Clause 5, the assembly of at least one of clauses 1-4, wherein the plurality of anti-extrusion petals are configured to retract into a running state for insertion or removal of the at least one anti-extrusion device into or out of the wellbore.

Clause 6, the assembly of at least one of clauses 1-5, comprising an expandable steel mesh surrounding the expandable sleeve.

Clause 7, the assembly of at least one of clauses 1-6, wherein the expandable sleeve provides a fluid barrier that prevents interaction between the sealing element and wellbore fluid located downhole from the sealing element.

Clause 8, the assembly of at least one of clauses 1-7, wherein the expandable sleeve comprises a material with a lower coefficient of friction than the plurality of anti-extrusion petals.

Clause 9, the assembly of at least one of clauses 1-8, wherein the expandable sleeve comprises at least 20% hydrogenated nitrile butadiene rubber.

Clause 10, the assembly of at least one of clauses 1-9, wherein the expandable sleeve comprises between 25% and 95% nylon or carbon fiber.

Clause 11, an anti-extrusion device, comprising: a shoulder configured to maintain contact with a downhole tool positioned uphole from the anti-extrusion device; a plurality of anti-extrusion petals positioned downhole from the shoulder and configured to expand radially outward from a longitudinal axis of the anti-extrusion device to an anti-extrusion diameter greater than a diameter of the shoulder; and an expandable sleeve surrounding the plurality of anti-extrusion petals that covers extrusion gaps of the plurality of anti-extrusion petals when the plurality of anti-extrusion petals are expanded radially outward from the longitudinal axis of the anti-extrusion device.

Clause 12, the device of clause 11, wherein the expandable sleeve comprises a nylon and rubber composite fabric, wherein the nylon and rubber composite fabric is chemically compatible with fluids present within the wellbore.

Clause 13, the device of clause 11 or 12, comprising a layer of expandable steel mesh or expandable fibers disposed around the expandable sleeve.

Clause 14, the device of at least one of clauses 11-13, comprising the downhole tool coupled to the anti-extrusion device, wherein the downhole tool comprises a cement plug.

Clause 15, the device of at least one of clauses 11-14, wherein the expandable sleeve comprises at least 20% hydrogenated nitrile butadiene rubber and between 25% and 80% nylon or carbon fiber.

Clause 16, a retrievable bridge plug assembly, comprising: a sealing element that is elastically deformable to expand radially outward when the sealing element experiences axial compression; at least one anti-extrusion composite sleeve surrounding at least an uphole end and a downhole end of the sealing element, wherein the at least one anti-extrusion composite sleeve comprises vertical reinforcement bands and horizontal linking bands with respect to a longitudinal axis of the sealing element, the horizontal linking bands configured to break as the sealing element compresses; and at least one anti-extrusion device positioned downhole form the sealing element.

Clause 17, the assembly of clause 16, wherein the sealing element comprises an elastomer, a thermoset, or a thermoplastic.

Clause 18, the assembly of clause 16 or 17, wherein the horizontal linking bands comprise a first tensile strength that is less than a second tensile strength of the vertical reinforcement bands.

Clause 19, the assembly of at least one of clauses 16-18, wherein the vertical reinforcement bands comprise carbon fibers, glass fibers, amarids, or any combination thereof, and the horizontal linking bands comprise carbon fibers, glass fibers, amarids, or any combination thereof.

Clause 20, the assembly of at least one of clauses 16-19, wherein the sealing element comprises a retrievable bridge plug, a packer, a thru tubing bridge plug, or any other wellbore sealing devices.

While this specification provides specific details related to certain components related to high expansion retrievable bridge plugs, it may be appreciated that the list of components is illustrative only and is not intended to be exhaustive or limited to the forms disclosed. Other components related to the operation of the high expansion retrievable bridge plugs will be apparent to those of ordinary skill in the art without departing from the scope and spirit of the disclosure. Further, the scope of the claims is intended to broadly cover the disclosed components and any such components that are apparent to those of ordinary skill in the art.

It should be apparent from the foregoing disclosure of illustrative embodiments that significant advantages have been provided. The illustrative embodiments are not limited solely to the descriptions and illustrations included herein and are instead capable of various changes and modifications without departing from the spirit of the disclosure.

What is claimed is:

1. A retrievable bridge plug assembly, comprising:

a sealing element that is elastically deformable to expand radially outward when the sealing element experiences axial compression; and at least one anti-extrusion device positioned downhole from the sealing element, the at least one anti-extrusion device comprising:

a shoulder configured to maintain contact with the sealing element;

a plurality of anti-extrusion petals positioned downhole from the shoulder and configured to expand radially outward from the anti-extrusion device when the anti-extrusion device is in a gripping state;

an expandable sleeve surrounding the plurality of anti-extrusion petals that covers extrusion gaps of the plurality of anti-extrusion petals when the plurality of anti-extrusion petals expand radially outward from the anti-extrusion device; and an expandable steel mesh surrounding the expandable sleeve.

2. The assembly of claim 1, wherein the expandable sleeve comprises a composite fabric comprising nylon, rubber, carbon fibers, composite cords, or any combination thereof, wherein the composite fabric is chemically compatible with fluids present within the wellbore.

3. The assembly of claim 2, wherein the nylon and rubber composite fabric is made using liquid injection molding, injection molding, compression molding, or a combination thereof.

4. The assembly of claim 1, wherein the plurality of anti-extrusion petals expand radially outward when the anti-extrusion device experiences pressure originating uphole from the anti-extrusion device, pressure originating downhole from the anti-extrusion device, or both.

5. The assembly of claim 1, wherein the plurality of anti-extrusion petals are configured to retract into a running state for insertion or removal of the at least one anti-extrusion device into or out of the wellbore.

6. The assembly of claim 1, wherein the expandable sleeve provides a fluid barrier that prevents interaction between the sealing element and wellbore fluid located downhole from the sealing element.

7. The assembly of claim 1, wherein the expandable sleeve comprises a material with a lower coefficient of friction than the plurality of anti-extrusion petals.

8. The assembly of claim 1, wherein the expandable sleeve comprises at least 20% hydrogenated nitrile butadiene rubber.

9. The assembly of claim 1, wherein the expandable sleeve comprises between 25% and 95% nylon or carbon fiber.

10. An anti-extrusion device, comprising:

a shoulder configured to maintain contact with a downhole tool positioned uphole from the anti-extrusion device;

a plurality of anti-extrusion petals positioned downhole from the shoulder and configured to expand radially outward from a longitudinal axis of the anti-extrusion device to an anti-extrusion diameter greater than a diameter of the shoulder;

an expandable sleeve surrounding the plurality of anti-extrusion petals that covers extrusion gaps of the plurality of anti-extrusion petals when the plurality of anti-extrusion petals are expanded radially outward from the longitudinal axis of the anti-extrusion device; and a layer of expandable steel mesh or expandable fibers disposed around the expandable sleeve.

11. The device of claim 10, wherein the expandable sleeve comprises a nylon and rubber composite fabric, wherein the nylon and rubber composite fabric is chemically compatible with fluids present within the wellbore.

12. The device of claim 10, comprising the downhole tool coupled to the anti-extrusion device, wherein the downhole tool comprises a cement plug.

13. The device of claim 10, wherein the expandable sleeve comprises at least 20% hydrogenated nitrile butadiene rubber and between 25% and 80% nylon or carbon fiber.

14. A plug assembly, comprising:

a sealing element that is elastically deformable to expand radially outward when the sealing element experiences axial compression;

at least one anti-extrusion composite sleeve surrounding at least an uphole end and a downhole end of the sealing element, wherein the at least one anti-extrusion composite sleeve comprises vertical reinforcement bands and horizontal linking bands with respect to a longitudinal axis of the sealing element, the horizontal linking bands configured to break as the sealing element compresses; and at least one anti-extrusion device positioned downhole form the sealing element.

15. The assembly of claim 14, wherein the sealing element comprises an elastomer, a thermoset, or a thermoplastic.

16. The assembly of claim 14, wherein the horizontal linking bands comprise a first tensile strength that is less than a second tensile strength of the vertical reinforcement bands.

17. The assembly of claim 14, wherein the vertical reinforcement bands comprise carbon fibers, glass fibers, amarids, or any combination thereof, and the horizontal linking bands comprise carbon fibers, glass fibers, amarids, or any combination thereof.

18. The assembly of claim 14, wherein the sealing element comprises a retrievable bridge plug, a packer, a thru tubing bridge plug, or any other wellbore sealing devices.

* * * * *